US006296550B1

(12) United States Patent
Liu et al.

(10) Patent No.: US 6,296,550 B1
(45) Date of Patent: Oct. 2, 2001

(54) SCALABLE MULTI-PAD DESIGN FOR IMPROVED CMP PROCESS

(75) Inventors: Erzhuang Liu; Yang Pan, both of Singapore (SG)

(73) Assignee: Chartered Semiconductor Manufacturing Ltd., Singapore (SG)

( * ) Notice: Subject to any disclaimer, the term of this patent is extended or adjusted under 35 U.S.C. 154(b) by 0 days.

(21) Appl. No.: 09/192,522

(22) Filed: Nov. 16, 1998

(51) Int. Cl.[7] ..... B24B 7/22
(52) U.S. Cl. ..... 451/41; 451/287; 451/486
(58) Field of Search ..... 451/41, 287, 290, 451/285, 63, 486

(56) References Cited

U.S. PATENT DOCUMENTS

| | | | | |
|---|---|---|---|---|
| 2,264,177 | * | 11/1941 | Harrington | 451/550 |
| 2,399,924 | * | 5/1946 | Hayward | 451/259 |
| 5,230,184 | | 7/1993 | Bukhman | 51/283 |
| 5,329,734 | | 7/1994 | Yu | 51/283 |
| 5,575,707 | | 11/1996 | Talieh et al. | 451/173 |
| 5,664,989 | | 9/1997 | Nakata et al. | 451/41 |
| 5,836,807 | * | 11/1998 | Leach | 451/287 |
| 5,934,979 | * | 8/1999 | Talieh | 451/290 |

FOREIGN PATENT DOCUMENTS

| | | | | |
|---|---|---|---|---|
| 06252113 | * | 9/1994 | (JP) | 451/41 |

* cited by examiner

*Primary Examiner*—Robert A. Rose
(74) *Attorney, Agent, or Firm*—George O. Saile; Rosemary L. S. Pike

(57) ABSTRACT

A new method of polishing very large diameter wafers. Multiple polishing pads are provided. Each polishing pad rotates around the Z-axis. Each pad can be individually controlled for Chemical Mechanical Planarization (CMP) process parameters such as pressure, rotation speed, slurry feed and slurry mixture. The planarization process can be controlled or optimized by individual rotating polishing pad or by a grouping of one or more rotating polishing pads. The wafer being processed can be rotated which further reduces the dependence on existing pad conditions which in turn translates into reduced use of slurry and prolonged life-time of the polishing pad.

17 Claims, 3 Drawing Sheets

SCALABLE MULTI-PAD DESIGN FOR IMPROVED CMP PROCESS

FIELD OF THE INVENTION

The invention relates to the fabrication of Semiconductor Wafers, and more specifically to a method of Chemical Mechanical Polishing (CMP) of very large semiconductor wafers of the type used in the fabrication of Integrated Circuits.

DESCRIPTION OF THE PRIOR ART

Integrated Circuits are conventionally fabricated from semiconductor wafers, each wafer contains an array of individual integrated circuit dies. It is of key importance that the wafer be polished to a planar configuration at various stages of the wafer processing stages. This requirement becomes increasingly more difficult to adhere to as the size of the wafer increases.

One of the most serious problems inherent in the CMP process is non-uniformity of the polishing rate over the entire surface of an object to be polished, e.g. a semiconductor wafer. A non-uniform rate of polishing results in not all surface regions of the wafer being polished equally which has a serious detrimental effect on the yield and reliability of the produced semiconductor elements. It is therefore of paramount importance to develop technology which permits further improving the uniformity of the polishing rate over the entire surface of the wafer, a requirement which becomes even more important as the size of the wafer increases.

The present invention addresses the problems of wafer polishing using Chemical Mechanical Planarization for very large wafers.

U.S. Pat. No. 5,575,707 (Talieh et al.) teaches a polishing pad cluster for polishing semiconductor wafers, the pads do not rotate.

U.S. Pat. No. 5,230,184 (Bukhman) teaches a plurality of periodic polishing pads, the pads do not rotate.

When processing a wafer, a conventional wafer clamping arrangement secures a wafer to a wafer cooling pedestal with a circular wafer clamping ring. The clamping ring is used to press the edge of the wafer into the continuous (sealing abutment with the upper surface of the wafer pedestal. A port or opening can be provided to flow a supply of an inert coolant gas, such as argon, to the backside of the wafer, this to improve thermal transfer between the wafer and the heater chuck. This takes advantage of the large thermal mass of the heater chuck relative to the wafer for conducting temperature. In this way, a predictable and consistent temperature is maintained across the wafer surface during wafer processing, and the various process steps that are used to fabricate devices on the wafer surface may be carried out in a reliable manner.

During standard PVD processing, deposition of the metal film on the surface of the semiconductor wafer typically results in the deposition of a metal film on the surface of the clamping ring. This deposition alters the profile (height and inner diameter) of the clamping ring, which in turn results in the metal ring, that is its modified profile, being shadowed on the semiconductor wafer which is being processed. This shadowing has a negative effect on wafer yield and must therefore be restricted or eliminated.

SUMMARY OF THE INVENTION

According to the present invention, a polishing pad cluster is provided for polishing very large semiconductor wafers comprising a plurality of integrated circuit dies. This cluster includes a pad support and a plurality of polishing pads, each of the polishing pads rotating in the plane of the wafer (around the vertical or Z axis) and each polishing pad individually controlled.

A principle object of the present invention is to provide a method of Chemical Mechanical Polishing (CMP) for very large wafers.

Another object of the present invention is to provide extended control over polishing rates of selected areas within the semiconductor wafer being polished.

Another object of the present invention is to maintain polishing uniformity across the wafer for very large wafers.

Another object of the present invention is to maintain process optimization by maintaining tight process parameter control for the processing of very large wafers.

Another object of the present invention is pad condition control and process parameter control across the area of the entire wafer for very large wafers.

In the first embodiment of the present invention the downward pressure of the rotating polishing pad is adjusted via a flexible membrane which is controlled by a pressure cavity. The interface between the the flexible membrane and the polishing pad is formed by ball-bearings.

In the second embodiment of the present invention the downward pressure of the rotating polishing pad is adjusted via a flexible membrane which is controlled by a pressure cavity. The interface between the the flexible membrane and the polishing pad is part of the membrane.

In the third embodiment of the present invention the downward pressure of the rotating polishing pad is controlled by magnets which form part of the rotating polishing pads.

In the fourth embodiment of the present invention the downward pressure of the rotating polishing pad is controlled by one large magnet which forms part of the wafer mount chuck assembly In the fifth embodiment of the present invention the downward pressure of the rotating polishing pad is controlled by passive mechanical weights which are part of the polishing pads.

BRIEF DESCRIPTION OF THE DRAWINGS

In the accompanying drawings, forming a material part of the description, there is shown:

FIG. 1 is a plan view of the polishing pad assembly of the present invention.

FIG. 2 is a cross-sectional view taken along line 2–2' of FIG.1.

FIG. 3 is a cross-sectional view of two polishing pads mounted in a flexible membrane via ball bearings.

FIG. 4 is a cross-sectional view of a polishing pad mounted in a flexible membrane where the mounting is part of the membrane.

FIG. 5 is a cross-sectional view of a polishing pad where the down-ward pressure on the polishing pad is exerted via magnets which form part of the polishing pad.

FIG. 6 is a cross-sectional view of a polishing pad where the down-ward pressure on the polishing pad is exerted via a large magnet which is mounted on the wafer mounting chuck.

FIG. 7 is a cross-sectional view of a polishing pad where the down-ward pressure on the polishing pad is exerted via mechanical weights.

DETAILED DESCRIPTION OF THE PREFERRED EMBODIMENTS

Figure 1:
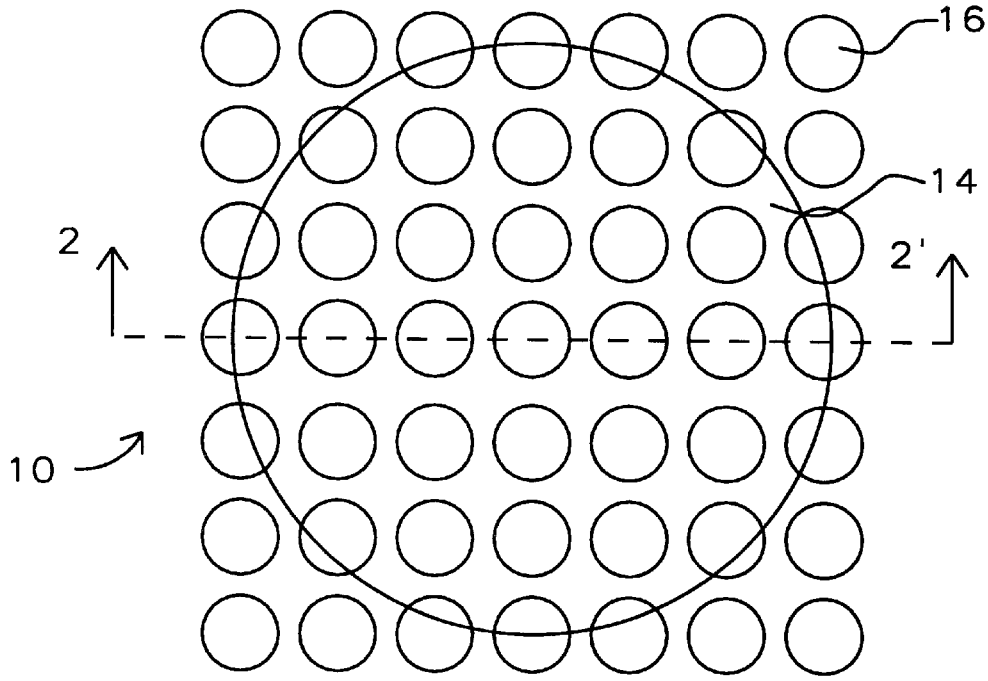
FIGS. 1 through 7 schematically illustrate a preferred embodiment of the implementation of the present invention.

Turning now to the drawings, FIGS. 1. through 7 relate to the preferred embodiment of the polishing pad assembly 10 of the present invention. The polishing pads 16 are designed for use in Chemical Mechanical Planarization of a wafer 14 that includes an array on integrated circuit dies. Typically, wafer 14 is mounted in a non-gimbaling wafer mount which provides a polishing force in the Z direction and rotates wafer 14 about the center of rotation C.

Figure 3:
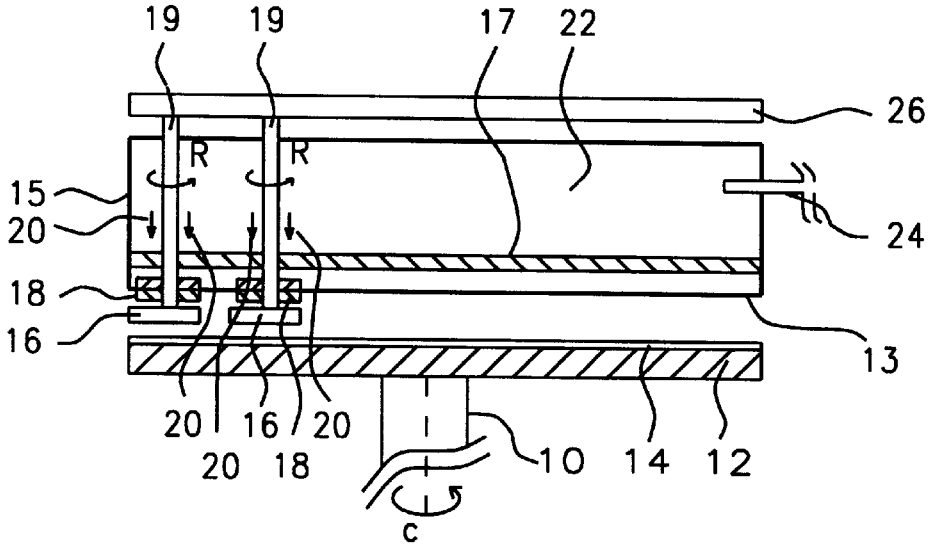

Referring now more particularly to FIG. 3 there is shown a cross-section view of an assemblage of polishing pads 16 in relation to the location of the wafer 14 which is being polished using the Chemical Mechanical Polishing (CMP) process. FIG. 3 presents, for reasons of drawing simplicity, only two of the multiplicity of possible rotating polishing pads.

Chuck 12 is made of a flat rigid material, such as stainless steel, so that it supports substrate 14. Substrate 14 is typically held on chuck 12 by a vacuum force that is commonly used and well understood in the semiconductor art and is not important for understanding the present invention. Chuck 12 is attached to a shaft or a movement means C that allows movement of chuck 12 in a vertical direction, a horizontal direction, rotational, and vibrational. It should be understood that when substrate 14 is held by chuck 12 that movement of chuck 12 is transferred to substrate 14. Additionally, any movement can be done simultaneously, such as vibrational movement while chuck 12 slowly rotates.

Figure 2:
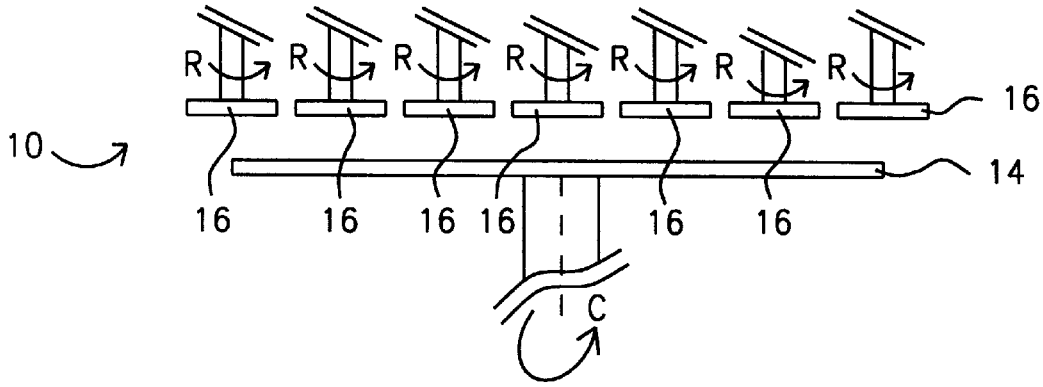

Turning now to the drawings, FIGS. 1 through 7 relate to the preferred embodiment of the polishing pad assembly 10 of the present invention. The polishing pads 16, FIGS. 1 and 2, are designed for use in Chemical Mechanical Planarization of a wafer 14 that includes an array on integrated circuit dies (not shown). Typically, wafer 14 is mounted in a non-gimbaling wafer mount, which provides a polishing force in the Z direction and rotates wafer 12 around a center of rotation C. FIG. 2 is a cross section that is taken along line 2–2' of FIG. 1 and further shows the rotation R of each of the polishing pads 16. Each of the polishing pads 16 is mounted on an axis that is rotated in direction R. Pressure can be applied (not shown) between the surface of the wafer 14 that is being polished and the polishing pads 16, this pressure can be controlled by individual polishing pads 16 or it can be controlled by combining one or more polishing pads in groups for the control and application of pressure. By applying this latter method of pressure control, polishing action can be controlled across the surface of the wafer, typically dependent on the radial distance of the polishing pads 16 and the center of rotation C of the wafer 14.

Chuck 12 with substrate is moved so that contact is made between substrate 14 and polishing pads 16. Pressure is allowed to enter cavity 22 through port 24, thereby creating pressure 20 which pushes the flexible membrane 13 in a downward or outward direction. As a result of this motion, polishing pads 16 are pressed in a downward or outward direction and conform to the unevenness or irregularities of substrate 14. If, in addition, each polishing pad 16 has approximately the same size as the die and if each polishing pad is positioned over a single die location on the substrate 14, this allows for polishing or planarization of each individual die, regardless of how warped or uneven the substrate 14 may be. Since, in addition, the polishing membrane 13 pushes polishing pads 16 into the substrate 14 with equal force or pressure, polishing rates for each individual polishing pad are relatively equal even on an irregular surface.

The flexible member 13 is attached to the side of the walls of cavity 22 by means of an edge ring (not shown) which provides support for the flexible membrane.

The polishing pads for the present invention may be used in virtually any application of the chemical mechanical planarization of semiconductor substrates. Many of the operating parameters when using the polishing pads should be similar to the parameters using conventional polishing pads. The slurry composition, polishing pad rotational velocity and substrate rotational velocity are all expected to be within the normal operating parameters of polishers with conventional polishing pads.

The shaft 19 on which the polishing pads 16 are mounted protrude through the flexible membrane 13 and are supported at each protrusion by ball bearings 18 which enable the polishing pad to rotate R around its axis. The ball bearings 18 employed are not part of the present invention, they may consist of one unit per polishing pad shaft or of two separate units per polishing pad shaft. If two separate units are used for the ball bearings 18 each of these units is mounted on the flexible membrane on the opposite side of the companion unit with both units belonging to the same protrusion of the polishing shaft.

The assemblage shown in FIG. 3 contains a driver mechanism 26 which stimulates the rotation R for each of the polishing pads 16. This driver mechanism 26 can drive all polishing pads 16 simultaneously or the driving of the polishing pads can be divided into one or more (multiple) zones. A zone in this context is understood to mean a functional grouping of one or more polishing pads such that these polishing pads exhibit the same characteristics of control, that is rotation R and downward pressure 20, and operation. Multiple driver zones allow for selective polishing of the wafer substrate 14 and introduces one more level of control for the polishing process. This additional level of control allows for selective polishing of specific wafer areas or dies to include different rotating speeds R and different uses of slurries. The method of implementing driver mechanism 26 is not part of this invention although all normal design parameters for such a driver mechanism apply. Where this driver mechanism is unique is that it must rotate the polishing pads 16 while providing a loose mechanical coupling to the polishing pads so as not to inhibit the effectiveness of the downward pressure 20.

Cavity 22 is further equipped with a perforated stabilizer plate 17 which restricts motion of the polishing pads in the X and Y direction. This plate may be required due to the relative length of the shaft or axis 19 of the polishing pads 16. In combination with this, the polishing pad 16 to polishing pad axis 19 interface may be of a design which allows the polishing pad 16 to articulate or move in the X-Y field thus further allowing the pad to more closely adhere to the surface of the wafer that is being polished. This feature however is not part of the present invention and can follow standard semiconductor polishing practices and implementations.

The indicated stabilizer plate 17 is optional, this plate must be perforated so as not to inhibit the downward pressure 20. The feed through of the polishing pad axis 19 through the stabilizer plate 17 must be rigid in the X-Y direction but must be loosely coupled in the Z direction, again so as not to inhibit or hinder pressure 20.

Figure 4:
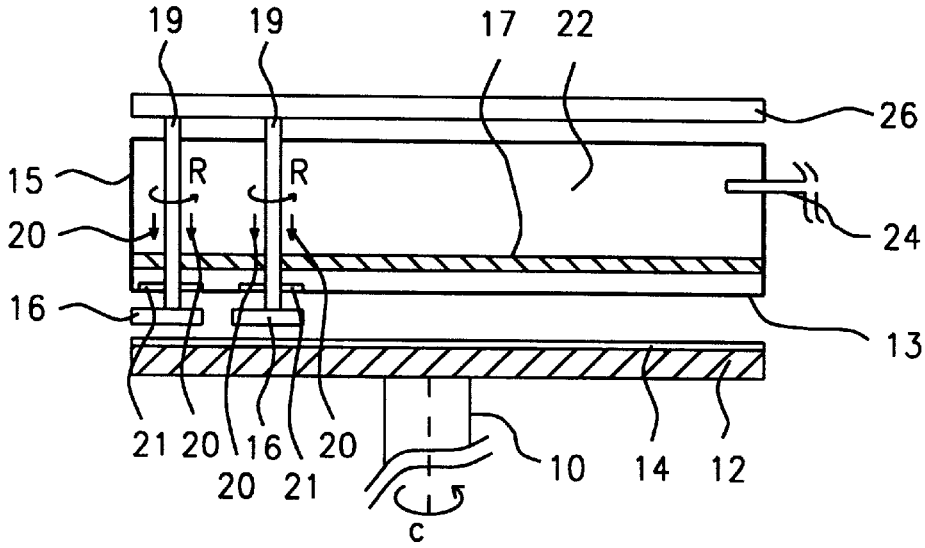

FIG. 4 differs from FIG. 3 in the technique used for the protrusion of the shafts 19 of the polishing pads 16 through the flexible membrane 17. In this embodiment of the present invention no ball bearings are used, the opening for protrusion is part of the flexible membrane.

Figure 5:
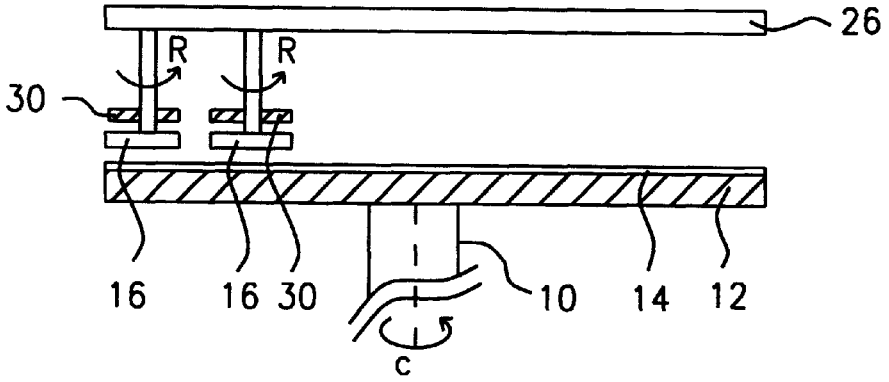

FIG. 5 shows an apparatus in cross sectional view where magnets 30 are used. Each polishing pad 16 has one corresponding magnet 30. The magnets 30 have an opening in the center which allows the shaft of the polishing pad 16 to move freely in the Z direction. The magnets 30 create a magnetic field which interacts with the polishing pad 16 so as to urge the polishing pad 16 toward wafer 14. If desired, the magnets 30 can be designed to create magnetic fields which are not uniform for all the magnets 30 applied. For example, in the situation where polishing rates tend to be greater near the periphery of the wafer 14 than near the center, the magnets 30 can provide stronger magnetic forces near the center of the wafer 14 than near the periphery in order to make the polishing rate more nearly uniform across the surface of the wafer. The inverse is also possible.

To create the magnetic fields, both permanent magnets and electro magnets can be used.

Figure 6:
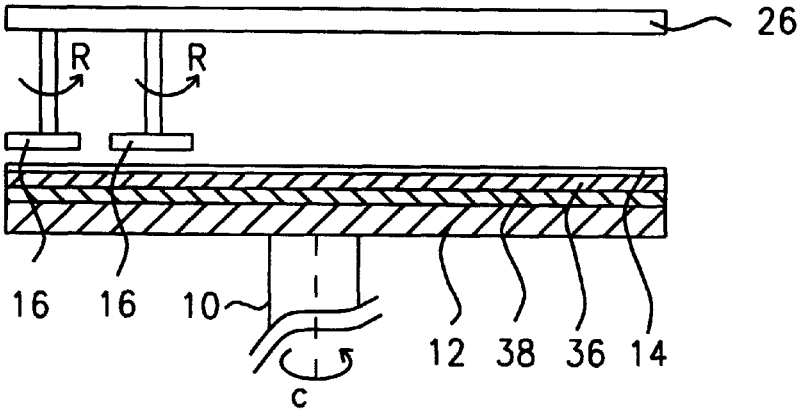

FIG. 6 shows the cross-sectional view of a wafer polishing apparatus where a large magnet 36 is mounted on top of and as part of the wafer chuck assembly 12. An insulating layer 38 insulates the magnetic field of magnet 36 from the chuck assembly 12 while also attaching the magnet 36 to the chuck assembly 12. Magnet 36 creates a magnetic field which interacts with the polishing pad 16 so as to urge the polishing pad toward the wafer. If desired, the magnet 36 can be designed to create magnetic fields which are not uniform across the magnet. For example, in the situation where polishing rates tend to be greater near the periphery of the wafer 14 than near the center, the magnet can provide stronger magnetic forces near the center of the wafer 14 than near the periphery in order to make the polishing rate more nearly uniform across the surface of the wafer. The inverse is also possible.

To create the magnetic fields, both a permanent magnets and electro magnetics can be used.

Figure 7:
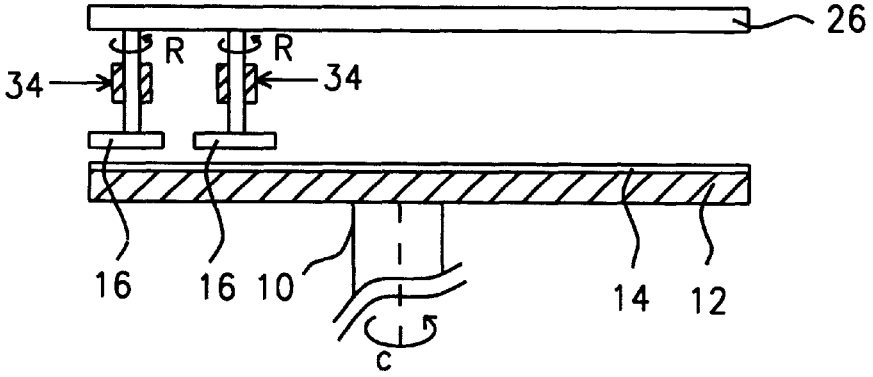

FIG. 7 shows a cross-sectional view of the wafer polishing apparatus where mechanical weights have been used to enhance polishing pad to wafer contact. These weights can be varied in size or weight such that the downward pressure exerted on the polishing pad can be varied resulting in selectivity of polishing speed for selected bands or areas or dies within the semiconductor wafer which is being polished.

This invention is not limited to the preferred embodiments described above, and a wide variety of polishing pads and polishing pad to polishing-axis joints can be used. A wide variety of polishing pad material cans also be used combined with or separate from a large variety of methods to stimulate or move the polishing pads in either the motion of rotation or in motion in the Z direction, that is the direction perpendicular to the plane of the wafer being polished.

It is therefore intended that the foregoing detailed description be regarded as illustrative rather than limiting, and that it be understood that it is the following claims, including all equivalents, which are intended to define the scope of this invention.

What is claimed is:

1. A scalable multi-pad polishing head design for polishing a surface of a semiconductor substrate comprising:

a multiplicity of rotating polishing pads whereby each of said rotating polishing pads is mounted on a rotating polishing pad shaft thereby providing rotating polishing pad shafts;

a flexible membrane through which said rotating polishing pad shafts are mounted;

a driving mechanism for rotation of said rotating polishing pad shafts;

a pressurized cavity to which said flexible membrane is attached which allows for uniform polishing across the surface of the semiconductor substrate being polished; and a stabilizing plate which stabilizes the rotating polishing pads in an X-Y plane.

2. The scalable multi-pad polishing head of claim 1 wherein the plurality of polishing pads are comprised of silicon.

3. The scalable multi-pad polishing head of claim 1 wherein the plurality of polishing pads are coated with a selected material having a characteristic hardness.

4. The scalable multi-pad-polishing head of claim 1 wherein the polishing pads are coated with a material that is selected from the group comprising diamond and nitride.

5. A scalable multi-pad polishing head design comprising:

a multiplicity of rotating polishing pads wherein each pad is mounted on a shaft;

a flexible membrane through which said rotating polishing pad shafts are mounted;

a driving mechanism for the rotation of said rotating polishing pads;

a pressurized cavity to which the flexible membrane is attached which allows for uniform polishing across the entire surface of the semiconductor being polished; and a stabilizing plate which stabilizes the rotating polishing pads in the X-Y plane;

a means for urging the semiconductor being polished against said rotating polishing pad; and a driving mechanism for the rotation of the rotating polishing pads.

6. The scalable multi-pad polishing head of claim 5 wherein the plurality of polishing pads are comprised of silicon.

7. The scalable multi-pad polishing head of claim 5 wherein the plurality of polishing pads are coated with a selected material having a characteristic hardness.

8. The scalable multi-pad polishing head of claim 5 wherein the polishing pads are coated with a material that is selected from the group comprising diamond and nitride.

9. A scalable multi-pad polishing head assembly for planarization of semiconductor wafers comprising:

a flexible membrane;

a multitude of flat rotating polishing pads mounted on a multitude of shafts which are functionally attached to said flexible membrane;

a means to deliver pressure to each individual rotating polishing pad across the flexible membrane;

a substrate chuck having a semiconductor wafer placed and held on said substrate chuck, whereby said wafer and the multiplicity of rotating polishing pads are pressed together so that the wafer and the multiplicity of rotating polishing pads are in contact; and a means of providing a motion to said substrate chuck.

10. A scalable rotating polishing head assembly of claim 9 wherein said motion provided to said substrate chuck is vertical.

11. A scalable rotating polishing head assembly of claim 9 wherein said motion provided to said substrate chuck is horizontal.

12. A scalable rotating polishing head assembly of claim 9 wherein said motion provided to said substrate chuck is rotational.

13. A scalable rotating polishing head assembly of claim 9 wherein said motion provided to said substrate chuck is vibrational.

14. A scalable rotating polishing head assembly of claim 9 wherein said motion provided to said substrate chuck is vertical.

15. A scalable multi-pad polishing head design for polishing a surface of a semiconductor substrate comprising:

a multiplicity of rotating polishing pads wherein each of said rotating polishing pads is mounted on a shaft;

a flexible membrane through which the rotating polishing pads are mounted;

a driving mechanism for rotation of said rotating polishing pads;

a pressurized cavity to which said flexible membrane is attached to apply pressure to said polishing pads to cause the rotating polishing pads to press against said surface of a semiconductor substrate which allows for uniform polishing across the surface of the semiconductor substrate being polished;

a stabilizing plate holding each said shaft on which each of said rotating polishing pads is mounted for stabilizing the rotating polishing pads in the X-Y plane;

a substrate chuck having a semiconductor substrate placed and held on said semiconductor substrate chuck, whereby a multiplicity of dies contacts the multiplicity of rotating polishing pads;

a means for selectively controlling rotational speed of the rotating polishing pads;

a means for grouping the rotating polishing pads into polishing zones; and a means for providing motion to the semiconductor substrate that is held on the substrate chuck against the multiplicity of rotating polishing pads, wherein the individual silicon polishing pad is grooved.

16. A scalable multi-pad polishing head design containing a multiplicity of rotating polishing pads for polishing of semiconductor substrate surfaces comprising:

a means for urging the rotating polishing pads against the surface of the semiconductor substrate being polished;

a driving mechanism for rotation of the rotating polishing pads;

a substrate chuck having a semiconductor substrate with a multiplicity of dies placed and held on the substrate chuck, whereby the multiplicity of dies and the multiplicity of rotating polishing pads are pressed together so that a multiplicity of dies contacts a multiplicity of rotating polishing pads;

a means for selectively controlling rotational speed of the rotating polishing pads;

a means for grouping the rotating polishing pads into polishing zones; and a means for providing motion to the substrate that is held on the substrate chuck against the multiplicity of rotating polishing pads, wherein the individual silicon polishing pad is grooved.

17. A method of planarizing a surface of a semiconductor substrate comprising:

providing a semiconductor substrate;

providing a distributed polishing head with a plurality of flat rotating polishing pads mounted on shafts in which each of said flat rotating polishing pads can be of a size aimed at polishing efficiencies or requirements for the semiconductor wafer being polished, wherein further each of said flat rotating polishing pads is in size approximately equal to each of the dies of the semiconductor wafer to a size aimed at polishing efficiencies or requirements for the overall semiconductor wafer being polished; and pressing the plurality of rotating polishing heads together with the surface of said semiconductor substrate that is being planarized in such a manner that the surface of said semiconductor substrate is in contact with said rotating polishing pads, thereby providing individual polishing pads for individual dies within said surface of said substrate or for other areas within the surface of said semiconductor substrate.

* * * * *